United States Patent [19]

Takihara

[11] Patent Number: 4,598,970

[45] Date of Patent: Jul. 8, 1986

[54] INTERNALLY SPLIT TYPE JACK

[75] Inventor: Yukio Takihara, Osaka, Japan

[73] Assignee: Hosiden Electronics Co., Ltd., Japan

[21] Appl. No.: 585,779

[22] Filed: Mar. 2, 1984

[30] Foreign Application Priority Data

Mar. 10, 1983 [JP] Japan ..... 58-35893[U]
Mar. 10, 1983 [JP] Japan ..... 58-35894[U]

[51] Int. Cl.[4] ..... H01R 17/18

[52] U.S. Cl. ..... 339/183; 339/256 R; 339/217 J

[58] Field of Search ..... 339/182, 183, 277 R

[56] References Cited

U.S. PATENT DOCUMENTS

| | | | |
|---|---|---|---|
| 2,137,258 | 11/1938 | Berger et al. | 339/183 |
| 3,148,010 | 9/1964 | Woodward | 339/182 R |
| 3,246,282 | 4/1966 | Mas et al. | 339/183 |
| 3,514,737 | 5/1970 | Renshaw, Jr. | 339/182 R |
| 3,957,331 | 5/1976 | Tantillo et al. | 339/182 R |
| 4,002,399 | 1/1977 | Deitch et al. | 339/182 R |
| 4,392,708 | 7/1983 | Bailey et al. | 339/182 R |
| 4,398,784 | 8/1983 | Takihara | 339/182 R |

*Primary Examiner*—Gil Weidenfeld
*Assistant Examiner*—David L. Pirlot
*Attorney, Agent, or Firm*—Steele, Gould & Fried

[57] ABSTRACT

An internally split type jack, comprising: a casing, the casing having a front end wall formed with a plug inlet hole and partition walls having plug passage holes formed therein aligned coaxially with the plug inlet hole and of substantially corresponding diameter, an inner casing wall of each housing space having a slot closed at one end formed therein; a plurality of electrical contact pieces mounted one in each of the housing spaces, each of the contact pieces comprising: a main body with a further plug passage hole therein substantially corresponding in diameter to the plug inlet hole; cooperating resilient contact-makers disposed on opposite sides of the further plug passage hole; and, one side edge adapted to slidably engage in the slot and so properly position the contact piece in the housing space to align the further plug passage hole coaxially with the plug inlet hole and the plug passage holes; and, at least one abutment disposed in at least one of the housing spaces to limit outward movement of at least one of the resilient contact-makers, whereby a plug inserted into and withdrawn from the jack will be guided during movement by the plug inlet hole and the plug passage holes, thereby passing smoothly through the further plug passage holes in the contact pieces, and will be resiliently clamped between the contact-makers of each contact piece during full insertion, the contact pieces being protected from damage due to misaligned movement of the plug into and out of the jack.

7 Claims, 6 Drawing Figures

INTERNALLY SPLIT TYPE JACK

BACKGROUND OF THE INVENTION

1. Field of the Invention

This invention relates to a jack incorporated into music apparatus, television sets, radio sets, etc. and more particularly to a compact internally split type jack whose casing is split into spaces for housing a plurality of contact pieces therein.

2. Prior Art

Commercial type jacks in general use, as shown in FIG. 4, are constructed of one chamber type casing 102 having a plug inlet 101 in front thereof and a required number of contact pieces 103, 104 and 105 placed inside the casing 102.

Jacks of the type described, however, have a common problem because a plug 106 inserted into the jack is chiefly held in position and alignment by a portion of a cylindrical plug inlet 101. The plug becomes loose with respect to the jack over time and with use, and the contact pieces are deformed by wrenching movements of the plug.

In an attempt to solve the problems described above, a jack as shown in FIGS. 5 and 6 has been proposed (Japanese Utility Model Publication No. 23266/1973). Particularly, the jack is of the construction in which a hole 114 for bringing the front end of the plug 113 inserted into the jack through a plug inlet 112 is formed in the rear wall 111 of a casing 110 having a required number of contact pieces 107, 108, 109 placed therein so as to prevent the plug 113 from becoming shaky by supporting the front end and base end portions of the plug 113 respectively in fixed relation with the plug inlet 112 and the hole 114.

In the jack of the type described above, however, because the front end portion of the plug more or less moves laterally and vertically before the end of the plug gets fitted into the hole 114 when the plug 113 is inserted into the plug through the inlet 112, there still remains the possibility that the contact pieces 107, 108 and 109 will become loose. Also, there is another disadvantage due to the great distance between the plug inlet 113 and the hole 114. It is not easy to fit the front end of the plug 113 into mating with the hole 114.

Furthermore, since the conventional jack of the above two types uses recoil spring type or slit-and-formed spring type contact pieces shown in FIGS. 4 to 6, the jack must have a casing considerably large enough in inner space to place a required number of such contact pieces inside the casing, with the result that the jack must be increased in size. This problem cannot be ignored in the light of the fact that music apparatus and the like have now the general tendency toward reduction in size.

SUMMARY OF THE INVENTION

This invention has been developed in view of the circumstances above, and has for its primary object the provision of a jack which permits smooth insertion of a plug thereinto as far as to the base of the plug without wrenching the contact pieces of the jack.

Another object of the invention is to provide a jack which is high in stability for holding a plug inserted therein and which is free from making the plug readily shaky.

Still another object of the invention is to provide a jack which permits substantial miniaturization.

These and other objects of the invention are achieved by an internally split type jack comprising a casing having a plug inlet in front thereof and which is internally split by partition walls into a plurality of plug receiving spaces, a plug passage hole substantially the same in diameter as the plug inlet and formed in each of the partition walls coaxially with the plug inlet, and contact pieces placed respectively in the spaces in a manner to be brought into resilient contact with the plug inserted from the plug inlet through the plug passage holes into the casing.

BRIEF DESCRIPTION OF THE DRAWINGS

Other features and advantages of the invention will become apparent from the following description of preferred embodiments of the invention given in conjunction with the accompanying drawings wherein.

DETAILED DESCRIPTION OF THE PREFERRED EMBODIMENTS

Figure 1:
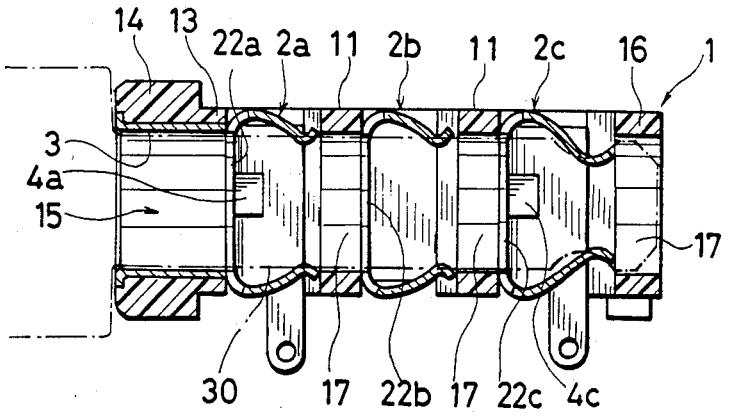
FIG. 1 is a longitudinal sectional view of one embodiment of the invention.
Figure 2:
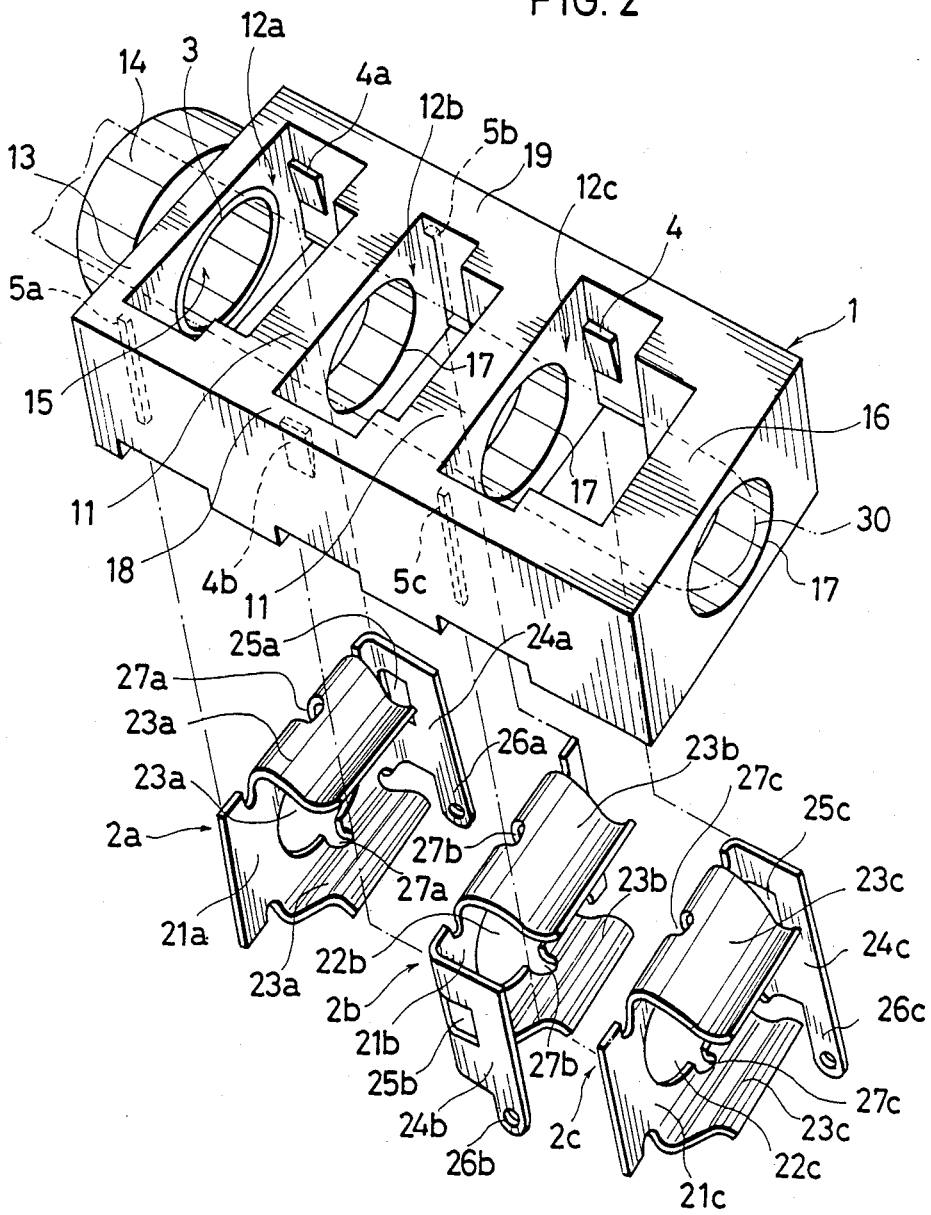
FIG. 2 is an exploded view in perspective of the embodiment in FIG. 1.
Figure 4:
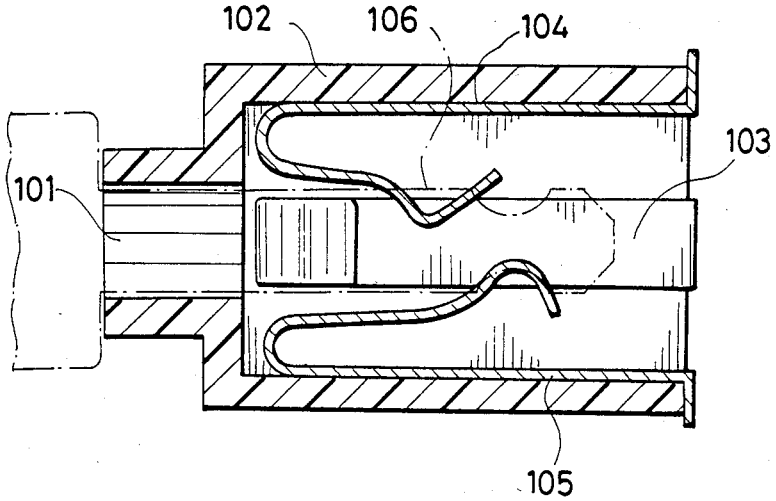
FIG. 4 PRIOR ART
FIG. 4 is a sectional view of an embodiment of a conventional type jack; and, FIGS. 5 and 6 are sectional and side views of another embodiment of the conventional type jack, respectively.
Figure 5:
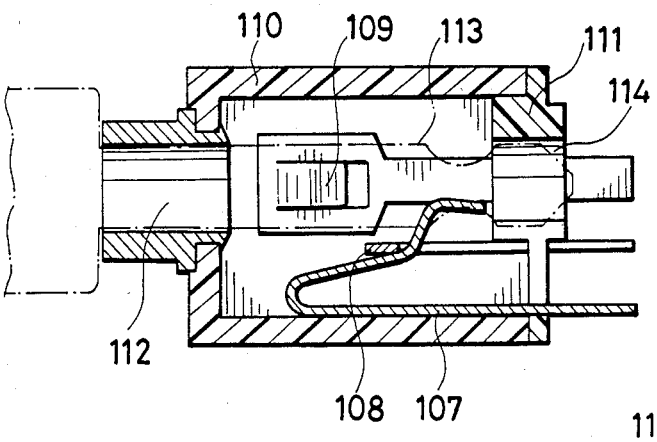
FIG. 5 PRIOR ART
Figure 6:
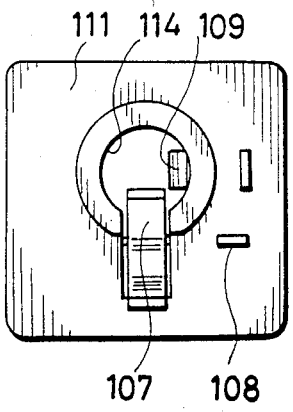
FIG. 6 PRIOR ART

In an embodiment of the invention shown in FIGS. 1 and 2, the numeral 1 designates a housing, and 2*a*, 2*b* and 2*c* designate an earthing contact piece, a ring contact piece and a tip contact piece, respectively.

The casing 1 defines spaces 12*a*, 12*b* and 12*c* for housing the contact pieces 2*a*, 2*b* and 2*c* therein respectively by partioning the interior of a square framelike body into three compartments by partition walls 11 and 11 at two intermediate points in the body. A metal sleeve 3 is inserted inside a short cylinder 14 projecting longitudinally beyond a frame side portion 13 on one end side of the framelike body for use as a plug inlet 13. Coaxially formed plug passage holes 17 are formed in the frame side portion 16 on the opposite side and the partition walls 11 and 11. Plug passage holes 17 are substantially the same in diameter as the plug inlet 15. On the inside surfaces of the frame side portions 18, 19 on both sides, transversely of the framelike body, there are provided, each in pairs, wedgelike projections 4*a*, 4*b* and 4*c* and fitting grooves 5*a*, 5*b* and 5*c* adapted to house and attach contact pieces 2*a*, 2*b* and 2*c* thereto in each of the spaces. And as will later by described in detail, for balance' sake, arrangement of the wedgelike projection 4*b* and groove 5*b* of the middle space 12*b* is reversed with respect to the spaces 12*a* and 12*c* on both ends.

An earthing or ground contact piece 2*a* is formed with a main body 21*a* having a further plug passage hole 22*a* in about the middle thereof, and is further provided with a pair of tonguelike resilient contact-makers 23*a* and 23*a* extending from upper and lower ends of the body 21*a*. The resilient contact-makers 23*a* and 23*a* are adapted to resiliently vertically clamp a plug 30 (earthing portion) passed through the plug passage hole 22*a* and are designed to come into resilient contact with the inserted plug 30 in that portion of the plug 30 adjacent to the ends of the contact-makers 23*a* and 23*a*. A fitting portion 24*a* is formed at one side end of the main body 21*a* of the contact piece 2*a* by being bent in a continued form from the main body 21*a*. The fitting portion 24*a* is formed with an opening 25*a* for receiving the aforesaid projection 4*a* therein. The lower portion of the fitting portion 24*a* forms a terminal 26*a*. The numeral 27*a* designates a notched groove for facilitating bending of the resilient contact-makers 23*a* and 23*a*.

A tip contact piece 2*c* is substantially the same in construction as the above-mentioned earthing contact piece 2*a*, and the ring contact piece 2*b* is also substantially the same except that the fitting portion 24*a* is reversely positioned. Accordingly, a detailed description in this respect is omitted by merely showing corresponding portions by the reference numerals.

The contact pieces 2*a*, 2*b* and 2*c* described above are inserted and unremovably nested in the respective spaces 12*a*, 12*b* and 12*c* by inserting one side edge of each of the main bodies 21*a*, 21*b* and 21*c* of contact pieces (side edge opposite the fitting portions 24*a*, 24*b* and 24*c*) from below the spaces 12*a*, 12*b* and 12*c* of the casing 1 into each of the mating grooves 5*a*, 5*b* and 5*c* and prssing the main bodies 21*a*, 21*b* and 21*c* until the wedgelike projections 4*a*, 4*b* and 4*c* are fitted into the respective openings 25*a*, 25*b* and 25*c*. As inserted, the backside of each contact piece 2*a*, 2*b* and 2*c* is brought into abutment against the frame piece portion 13 and partition walls 11 and 11 in such a manner that the respective further plug passage holes 22*a*, 22*b* and 22*c* of contact pieces 2*a*, 2*b* and 2*c* are aligned with the plug inlet 15 and the plug passage holes 17, 17 of the partition walls 11 and 11 to bring the inlet 15 and holes 17 and 17 into coaxially aligned position with the plug inlet 15.

In the internally split type jack of the construction described above, when a plug 30 is inserted through the plug inlet 15, the end of the plug 30 is passed through the respective plug passage holes 17, 17 and 22*a*, 22*b* and 22*c* of the partition walls 11, 11 and each contact piece 2*a*, 2*b* and 2*c* thereby expands slightly vertically and resiliently. The resilient contact-makers 23*a* and 23*a*, 23*b* and 23*b*, and 23*c* and 23*c* of the respective contact pieces assist and guide the end of the plug 30 in reaching the plug passage hole 17 of the frame side portion 16 on the opposite side. During insertion, the partition walls 11 and 11 serve as protective walls of the contact pieces 2*b* and 2*c* and the plug passage holes 17 and 17 of the partition walls also serve as guide holes for leading the plug in the direction of insertion of the plug. Accordingly, the plug 30 is can pass through the plug inlet 15 straight toward the plug passaage hole 17 of the frame piece 16 on the opposite side of the plug inlet without the plug wrenching each or any of the contact pieces 2*a*, 2*b* and 2*c*. Accordingly, the plug insertion operation of the plug 30 can be made very smoothly.

When the plug 30 is inserted to its base portion in this manner, the earthing portion, ring portion and tip portion of the plug 30 are resiliently clamped from above and below by resilient contact-makers 23*a*, 23*a* of contact piece 2*a*, resilient conact-makers 23*b*, 23*b* of contact piece 2*b*, and resilient contact-makers 23*c*, 23*c* of contact piece 2*c* and are thus connected electrically and in this state the plug 30 is restricted against vertical and lateral movement by the plug inlet 15 and plug passage holes 17. The plug is also uniformly clamped vertically by the resilient contact-makers of the contact pieces, so that the plug 30 is effectively prevented from becoming shaky or loose. Accordingly, there is no possibility of the plug 30 making each contact piece 2*a*, 2*b* and 2*c* shaky or loose after insertion of the plug.

Since each contact piece 2*a*, 2*b* and 2*c* is of the construction in which each pair of resilient contact-makers 23*a*, 23*b* and 23*c* are provided on both ends of each main body 21*a*, 21*b* and 21*c* of the contact pieces, having plug passage holes 22*a*, 22*b* and 22*c* respectively therein, each of the contact pieces makes it possible to reduce the longitudinal and lateral sizes of the casing 1 to a substantial degree. The contact pieces 2*a*, 2*b* and 2*c* work effectively as long as the respective main bodies 21*a*, 21*b* and 21*c* of the contact pieces are large enough in longitudinal and lateral sizes to permit the formation of further plug passage holes 22*a*, 22*b* and 22*c* in each contact piece 2*a*, 2*b* and 2*c*. Accordingly, the contact piece can be made smaller to a substantial degree than the recoil spring type or slit-and-formed spring type contact piece conventionally used.

Furthermore, the internally split type jack of the invention is of the construction in which the contact piece 2*b* is mounted in such a manner that the wedgelike projection 4*b* and mating groove 5*b* of the space 12*b* in the middle of the casing are positioned in opposite relation with those of the other spaces 12*a* and 12*c*. The jack is free from the disadvantage of attachment of contact pieces in the so-called cantilever state and instead has the contact pieces balanced in position, thus greatly contributing toward the smooth insertion of the plug.

Figure 3:
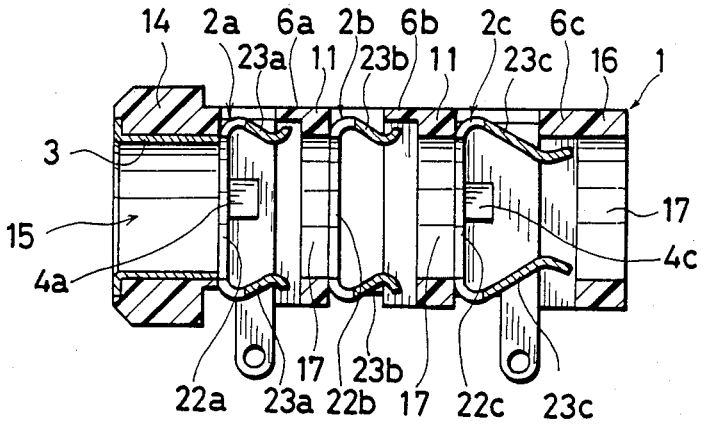
FIG. 3 is a longitudinal sectional view of another embodiment of the invention.

FIG. 3 shows still another embodiment of the jack of the invention wherein stoppers or abutments 6*a*, 6*b* and 6*c* project forwardly at the respective upper ends of the partition walls 11, 11 and the rear end frame side portion 16, for preventing the upper resilient contact-makers 23*a*, 23*b* and 23*c* of contact pieces 2*a*, 2*b* and 2*c* from expanding upwardly beyond a specific limit, so as to make extra assurance that each contact piece is protected from being wrenched. The embodiment is the same in other respects of construction as the jack shown in FIGS. 1 and 2.

What is claimed is:

1. An internally split type jack, comprising:

a casing, the casing having a front end wall formed with a plug inlet hole and partition walls having plug passage holes formed therein aligned coaxially with the plug inlet hole and of substantially corresponding diameter, an inner casing wall of each housing space having formed therein a slot closed at one end;

a plurality of electrical contact pieces mounted one in each of the housing spaces, each of the contact pieces comprising;

a main body with a further plug passage hole therein substantially corresponding in diameter to the plug inlet hole;

cooperating resilient contact-makers disposed on opposite sides of the further plug passage hole; and, a side edge adapted to slidably engage in the slot and so properly position the contact piece in the housing space to align the further plug passage hole coaxially with the plug inlet hole and the plug passage holes;

a bottom wall for the casing, the bottom wall having openings therein for receiving the contact pieces, the slots each having an open end at the bottom wall communicating with one of the openings, whereby the contact pieces may be slidably inserted into the housing spaces through the openings, being guided into and held in position by the slots, the closed end of each slot preventing movement of each contact piece beyond the position of coaxial alignment; and, at least one abutment disposed in at least one of the housing spaces to limit outward movement of at least one of the resilient contact-makers, whereby a plug inserted into and withdrawn from the jack will be guided during movement by the plug inlet hole and the plug passage holes, thereby passing smoothly through the further plug passage holes in the contact pieces, and will be resiliently clamped between the contact-makers of each contact piece during full insertion, the contact pieces being protected from damage due to misaligned movement of the plug into and out of the jack.

2. A jack according to claim 1, further comprising means formed partially on each of the contact pieces and partially within each of the housing spaces for locking each of the contact pieces into the coaxially aligned position.

3. A jack according to claim 1, further comprising means formed partially on each of the contact pieces and partially within each of the housing spaces for locking each of the contact pieces into the coaxially aligned position.

4. A jack according to claim 1, comprising a plurality of abutments disposed in a plurality of the housing spaces.

5. A jack according to claim 1, wherein the casing further comprises a rear end wall opposite the front end wall, the rear end wall having an opening therein coaxially aligned with the plug inlet hole and the plug passage holes and adapted to receive the distal end of the plug.

6. A jack according to claim 1, wherein the at least one abutment is disposed in that one of the housing spaces furthest from the front end wall.

7. A jack according to claim 6, further comprising means formed partially on each of the contact pieces and partially within each of the housing spaces for locking each of the contact pieces into the coaxially aligned position.

* * * * *